US011280280B1

(12) United States Patent
Dudar et al.

(10) Patent No.: US 11,280,280 B1
(45) Date of Patent: Mar. 22, 2022

(54) METHODS AND SYSTEMS FOR CONTROLLING REDUCING ENGINE EMISSIONS

(71) Applicant: Ford Global Technologies, LLC, Dearborn, MI (US)

(72) Inventors: Aed Dudar, Canton, MI (US); Keith Weston, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/209,002

(22) Filed: Mar. 22, 2021

(51) Int. Cl.

| | |
|---|---|
| ***F02D 41/00*** | (2006.01) |
| ***F02D 41/06*** | (2006.01) |
| ***F02D 9/02*** | (2006.01) |
| ***F02D 41/14*** | (2006.01) |

(52) U.S. Cl.
CPC ..... *F02D 41/0002* (2013.01); *F02D 9/02* (2013.01); *F02D 41/064* (2013.01); *F02D 41/1459* (2013.01); *F02D 2009/0279* (2013.01); *F02D 2200/0802* (2013.01)

(58) Field of Classification Search
CPC . F02M 35/0218; F02D 9/02; F02D 2009/279; F02D 2200/0802; F02D 41/0002; F02D 41/064; F02D 41/1459
See application file for complete search history.

(56) References Cited

U.S. PATENT DOCUMENTS

| | | | | |
|---|---|---|---|---|
| 5,307,627 | A * | 5/1994 | Christensen | F01N 3/0878 60/274 |
| 5,894,726 | A * | 4/1999 | Monnier | F02D 41/0082 60/274 |
| 6,889,671 | B2 | 5/2005 | Rigney | |
| 8,636,622 | B2 | 1/2014 | Ulrey et al. | |
| 10,183,660 | B2 | 1/2019 | Dudar | |
| 2002/0059920 | A1* | 5/2002 | Yoshioka | F02M 35/10019 123/518 |
| 2002/0092293 | A1* | 7/2002 | Yasui | F01N 13/009 60/278 |
| 2003/0056770 | A1* | 3/2003 | Honda | F02M 35/10216 123/516 |
| 2003/0136386 | A1* | 7/2003 | Itakura | F02M 35/1255 123/520 |
| 2004/0084010 | A1* | 5/2004 | Kurtz | F02B 17/005 123/295 |
| 2006/0054142 | A1* | 3/2006 | Burke | F02M 25/08 123/518 |
| 2006/0150956 | A1* | 7/2006 | Burke | F02M 35/10144 123/518 |
| 2009/0120061 | A1* | 5/2009 | Elwart | F01N 5/02 60/274 |

(Continued)

FOREIGN PATENT DOCUMENTS

| | | | |
|---|---|---|---|
| JP | 2009156205 A | * | 7/2009 |
| JP | 2009156205 A | | 7/2009 |

*Primary Examiner* — John M Zaleskas
(74) *Attorney, Agent, or Firm* — Geoffrey Brumbaugh; McCoy Russell LLP

(57) ABSTRACT

Systems and methods for operating an engine that includes dual throttles are disclosed. In one example, positions of the dual throttles may be adjusted to limit flow of hydrocarbons from a hydrocarbon trap during cold engine starting so that an amount of hydrocarbons that reach atmosphere may be reduced. Each of the dual throttles may be positioned in a separate engine air intake passage.

15 Claims, 4 Drawing Sheets

(56) References Cited

U.S. PATENT DOCUMENTS

2009/0120063 A1* 5/2009 Uhrich ..... F01N 5/02 60/278
2009/0120064 A1* 5/2009 Uhrich ..... F02M 25/089 60/278
2009/0120065 A1* 5/2009 Uhrich ..... F01N 5/02 60/284
2010/0011746 A1* 1/2010 Lupescu ..... F02M 25/12 60/278
2010/0024396 A1* 2/2010 Lupescu ..... F01N 3/0807 60/284
2010/0065030 A1* 3/2010 Bellis ..... F02M 25/089 123/574
2010/0162994 A1* 7/2010 Elsa er ..... F02B 29/083 123/337
2011/0072801 A1* 3/2011 Lupescu ..... F02M 26/06 60/287
2011/0132337 A1* 6/2011 Lupescu ..... F02D 41/0065 123/568.21
2014/0318504 A1* 10/2014 Pearce ..... F02D 41/0045 123/518
2014/0318506 A1* 10/2014 Yang ..... F02D 41/0032 123/519
2015/0120108 A1* 4/2015 Dudar ..... B60W 20/00 701/22
2016/0215711 A1* 7/2016 Dudar ..... B60W 20/00
2016/0319718 A1* 11/2016 Dudar ..... F01N 3/00
2017/0030271 A1* 2/2017 Dudar ..... B60W 30/18054
2017/0082043 A1* 3/2017 Dudar ..... F01N 3/103
2017/0218826 A1* 8/2017 Uhrich ..... F01N 9/00
2017/0234246 A1* 8/2017 Dudar ..... B60W 20/40 701/22
2017/0356403 A1 12/2017 Zhao
2018/0010532 A1* 1/2018 Dudar ..... F02D 41/0035
2019/0234326 A1* 8/2019 Dudar ..... F02D 41/0037
2020/0369508 A1* 11/2020 Dudar ..... B60K 15/03504
2020/0370516 A1* 11/2020 Dudar ..... F02M 25/0854

* cited by examiner

METHODS AND SYSTEMS FOR CONTROLLING REDUCING ENGINE EMISSIONS

FIELD

The present description relates to a system and methods for reducing cold start emissions of an internal combustion engine. The system and methods may be particularly useful for dual intake passage engines.

BACKGROUND AND SUMMARY

An engine may be equipped with dual throttles so that a pressure drop into the engine may be reduced at high engine loads. The dual throttles may also allow engine output power to be increased. However, the dual throttles also provide two paths for hydrocarbons to migrate from the engine to the atmosphere when the engine is stopped. One way to reduce hydrocarbon emissions through the engine's intake system is to install a hydrocarbon trap in the engine's intake system. Hydrocarbons stored in the hydrocarbon trap may be released into the engine when the engine is restarted. Nevertheless, if the engine is being cold started and hydrocarbons are being converted with less efficiency via a catalyst in the engine's exhaust system due to low catalyst temperature, the hydrocarbons that were once trapped in the hydrocarbon trap may make it to the atmosphere. Therefore, it may be desirable to reduce a possibility of once trapped hydrocarbons from reaching the atmosphere during cold engine starting.

The inventors herein have recognized the above-mentioned disadvantages and have developed a method for operating an engine, comprising: adjusting a first throttle to a first position and a second throttle to a second position via a controller in response to an amount of hydrocarbons stored in a first hydrocarbon trap and an amount of hydrocarbons stored in a second hydrocarbon trap.

By adjusting a first throttle to a first position and a second throttle to a second position, it may be possible to reduce release of hydrocarbons to atmosphere. In particular, the first throttle may be partially opened to allow the engine to idle during an engine cold start while the second throttle is fully closed. Fully closing the second throttle may prevent or reduce air flow across an intake hydrocarbon trap so that hydrocarbons may not be ingested into the engine during the cold start. Preventing the hydrocarbons from enter the engine during a cold engine start may reduce tailpipe emissions because the hydrocarbons may remain trapped until the engine's catalyst has exceeded light-off temperature. The hydrocarbons may be released into the engine after the catalyst reaches light-off temperature so that there may be less possibility of the hydrocarbons reaching the atmosphere.

The present description may provide several advantages. In particular, the approach may reduce hydrocarbons that are released into the atmosphere. Further, the approach may prioritize how intake hydrocarbon traps are purged to reduce hydrocarbon emissions. In addition, the approach may be applied to high performance engines so that these engines may meet emissions regulations.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
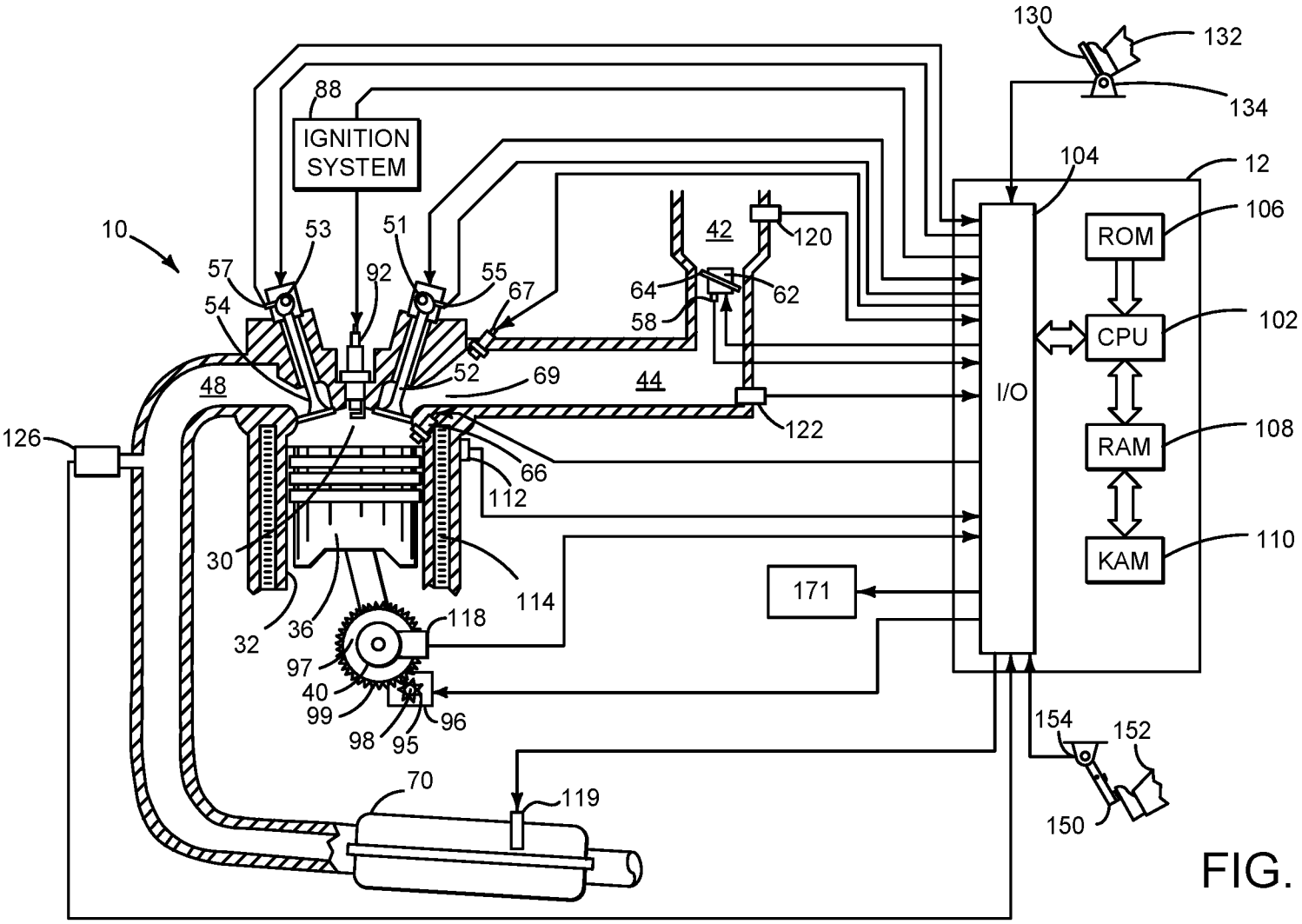
FIGS. 1 and 2 are schematic diagrams of an engine.
Figure 2:
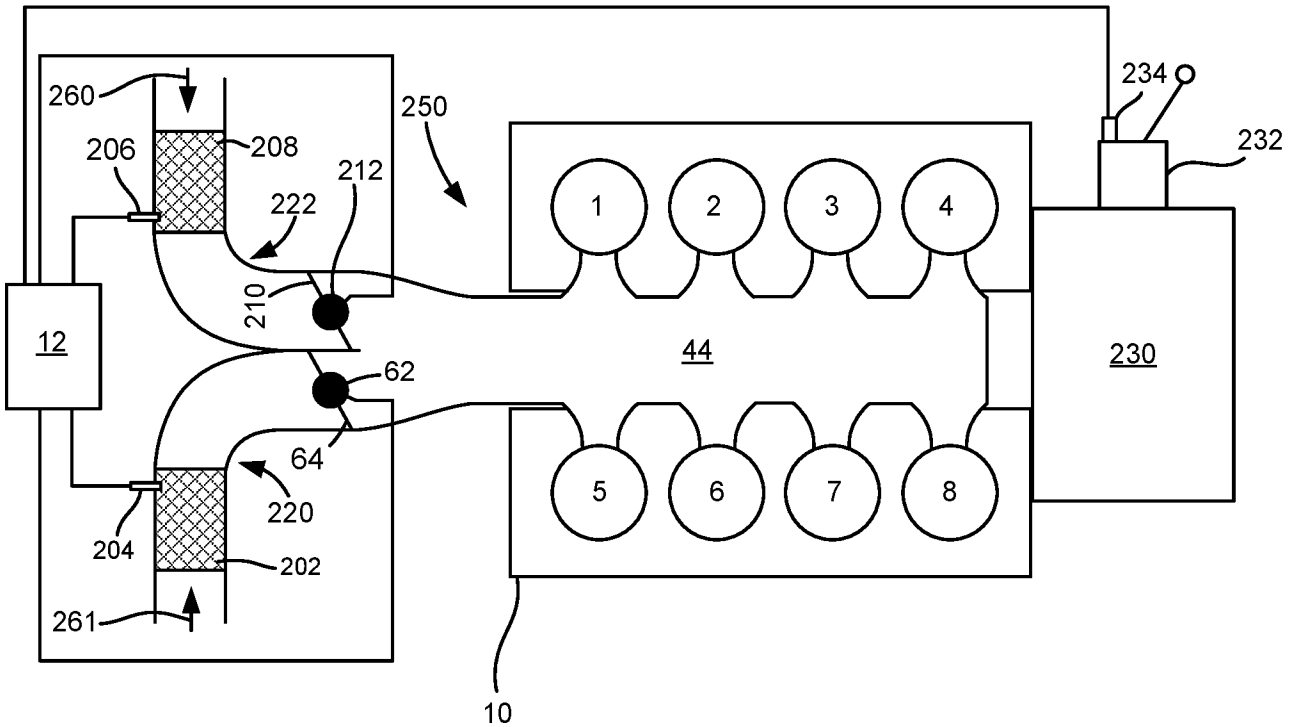
Figure 3:
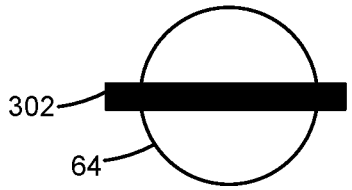
FIG. 3 shows an example view of a throttle plate.
Figure 4:
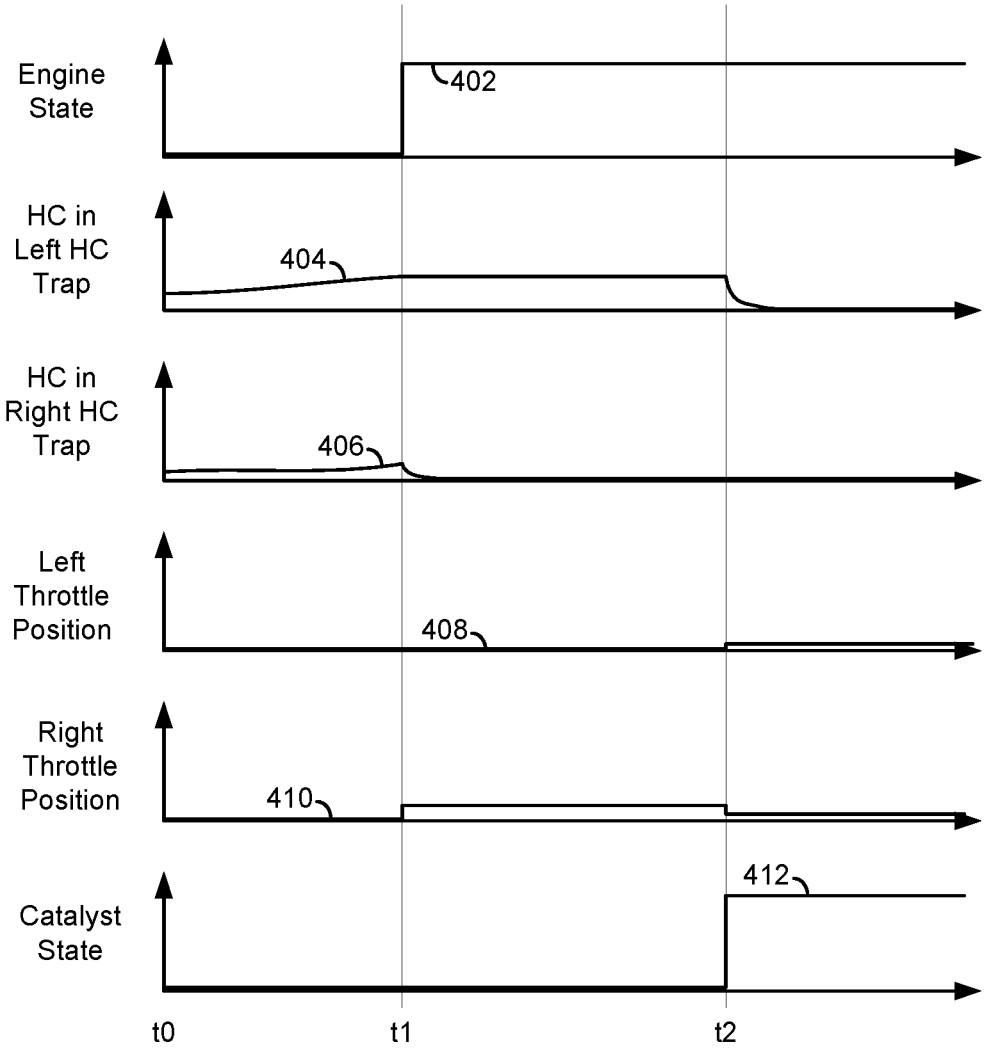
FIG. 4 shows an example engine cold start sequence.
Figure 5:
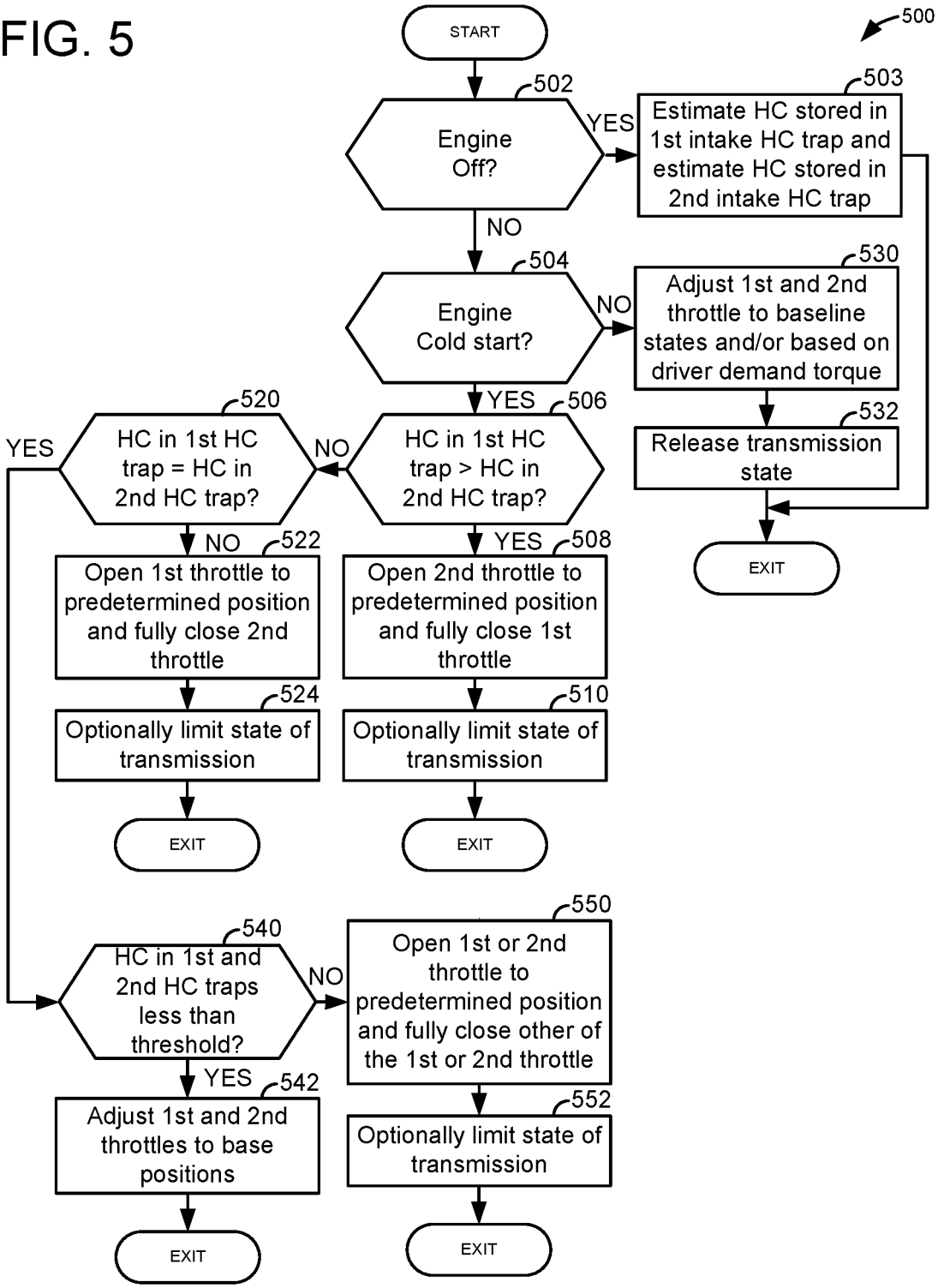
FIG. 5 shows an example method for operating an internal combustion engine.

The present description is related to operating an engine that includes two throttles. The engine may be operated in a way that reduces emissions of hydrocarbons during an engine cold start. In one example, a throttle positioned along an intake passage is fully closed during an engine cold start so that hydrocarbons that are held within a hydrocarbon trap upstream of the fully closed throttle may remain in the hydrocarbon trap until a catalyst within an exhaust system is prepared to efficiently convert the hydrocarbons to $CO_2$ and $H_2O$. After the catalyst reaches a desired operating temperature, the trapped hydrocarbons may be released and converted if they are not combusted within the engine. FIGS. 1 and 2 show a non-limiting example engine in which the methods described herein may be applied. FIG. 3 shows a detailed view of an example throttle plate that may help to reduce release of hydrocarbons from a hydrocarbon trap. An example engine operating sequence according to one of the methods described herein is shown in FIG. 4. Finally, a method for operating an engine to reduce hydrocarbon emissions is shown in FIG. 5.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Port fuel injector 67, injects fuel to intake port 69, which is known to those skilled in the art as port injection. Fuel injector 66 delivers liquid fuel in proportion to a voltage pulse width or fuel injector pulse width of a signal from controller 12. Likewise, fuel injector 67 delivers liquid fuel in proportion to a voltage pulse width or fuel injector pulse width from controller 12. Fuel is delivered to fuel injectors 66 and 67 by a fuel system (not shown) including a fuel tank, fuel pump, and fuel rail (not shown). Fuel is supplied to direct fuel injector 66 at a higher pressure than fuel is supplied to port fuel injector 67. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a propulsive effort pedal 130 for sensing force applied by a human foot 132; a position sensor 154 coupled to brake pedal 150 for sensing force applied by a human foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may receive input and communicate conditions such as degradation of components to light, or alternatively, human/machine interface 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, an alternate view of engine 10 of FIG. 1 is shown. Engine 10 is shown with eight cylinders that are numbered 1-8 relative to front of engine 250. The engine cylinders 1-8 are supplied with air via the common intake manifold 44. The intake manifold 44 may be supplied with air via dual throttles 62 and 212. Throttle 62 includes throttle plate 64 and throttle 212 includes throttle plate 210. Throttles 62 and 212 may be electrically controlled throttles. In this example, throttle 212 may be referred to as a left throttle or first throttle and throttle 62 may be referred to as a right throttle or second throttle. Left throttle 212 is located along left or first intake passage 222 and right throttle 64 is located along right or second intake passage 220. Left intake passage 222 also includes a first hydrocarbon trap 208 for trapping hydrocarbons that may migrate from engine cylinders 1-8 when the engine 10 is stopped and not rotating. Likewise, right intake passage 220 includes a second hydrocarbon trap 202 for trapping hydrocarbons that may migrate from engine cylinders 1-8 when the engine 10 is not rotating. The left intake passage 222 may also include a temperature sensor 206 for inferring an amount of hydrocarbons that may be stored in hydrocarbon trap 208. A temperature increase within hydrocarbon trap 208 may be proportional to an amount of hydrocarbons that are stored in hydrocarbon trap 208. Similarly, the right intake passage 220 may also include a temperature sensor 204 for inferring an amount of hydrocarbons that may be stored in hydrocarbon trap 202. A temperature increase within hydrocarbon trap 202 may be proportional to an amount of hydrocarbons that are stored in hydrocarbon trap 202. Hydrocarbon trap 208 is positioned in left intake passage 222 upstream of throttle 210 and cylinders 1-8 according to a direction of air flow into engine 10 as indicated by arrow 260. Hydrocarbon trap 202 is positioned in right intake passage 220 upstream of throttle 64 and cylinders 1-8 according to a direction of air flow into engine 10 as indicated by arrow 261.

Engine 10 may supply rotational torque to transmission 230. Transmission 230 may be an automatic fixed stepped gear ratio transmission, a manual transmission, or a continuously variable transmission. A human operator may select an operating state of transmission 230 via a shift selector 232. Controller 12 may optionally prevent shifter 232 from engaging a forward gear or reverse gear until predetermined conditions are met. Controller 12 may optionally prevent shifter 232 from engaging a gear via a shift control actuator 234 (e.g., a solenoid).

Controller 12 may infer amounts of hydrocarbons stored in hydrocarbon traps via temperature sensors 204 and 206 while engine 10 is stopped and not rotating. In one example, temperature changes within hydrocarbon traps 202 and 208 may be applied to reference tables or functions stored in non-transitory memory of controller 12 that output estimates of amounts of hydrocarbons stored in hydrocarbon traps 202 and 208. Controller 10 may adjust positions of throttles 62 and 212 according to the amounts of hydrocarbons stored in the hydrocarbon traps as discussed in further detail with regard to method 500.

Thus, the system of FIGS. 1 and 2 provides for a system, comprising: an internal combustion engine including a first intake passage and a second intake passage, the first intake passage including a first throttle and a first hydrocarbon trap, the second intake passage including a second throttle and a second hydrocarbon trap; and a controller including executable instructions stored in non-transitory memory that cause the controller to partially open the first throttle and fully close the second throttle in response to an first amount of hydrocarbons stored in the first hydrocarbon trap and a first amount of hydrocarbons stored in a second hydrocarbon trap. The system includes where the first throttle is partially opened and the second throttle is fully closed in response to the first amount of hydrocarbons stored in the second hydrocarbon trap exceeding the first amount of hydrocarbons stored in the first hydrocarbon trap. The system further comprises additional instructions that cause the controller to partially open the second throttle and fully close the first throttle in response to a second amount of hydrocarbons stored in the first hydrocarbon trap and a second amount of hydrocarbons stored in the second hydrocarbon trap.

In some examples, the system further comprises additional instructions to adjust the first throttle to a first base position and adjust the second throttle to second base position in response to a temperature of a catalyst exceeding a threshold temperature. The system includes where the threshold temperature is a light-off temperature of the catalyst. The system includes where the first hydrocarbon trap is positioned upstream of the first throttle, and where the second hydrocarbon trap is positioned upstream of the second throttle. The system further comprises a transmission shifter and additional instructions to limit movement of the transmission shifter while the first throttle is partially open and the second throttle is fully closed. The system further comprises additional instructions to estimate the first amount of hydrocarbons stored in the first hydrocarbon trap and the first amount of hydrocarbons stored in the second hydrocarbon trap while the internal combustion engine is stopped.

Referring now to FIG. 3, a plan view of throttle plate 64 is shown. Throttle plate 64 is shown as a solid piece of material that includes no through holes for air to pass through throttle plate 64. Throttle plate 64 substantially seals all air flow past throttle plate 64 when throttle plate is in a fully closed position. Throttle plate 64 seals against a throttle bore (not shown) to prevent air flow through an intake passage when throttle plate 64 shown in FIGS. 1 and 2 is in a fully closed position. Throttle plate 64 may rotate about shaft 302 when it is in operation. Throttle plate 210 shown in FIG. 2 may be constructed in a similar way.

Turning now to FIG. 4, an engine operating sequence according to the method of FIG. 5 is shown. The sequence of FIG. 4 may be provided via the system of FIGS. 1 and 2 in cooperation with the method of FIG. 5. The plots of FIG. 4 are aligned in time. The vertical lines at times t0-t2 represent times if interest in the sequence.

The first plot from the top of FIG. 4 is a plot of engine operating state versus time. The vertical axis represents engine state and the engine state is off and not rotating when trace 402 is at a lower level near the horizontal axis. Trace 402 represents the engine operating state. The engine is on and rotating when trace 402 is at a higher level near the vertical axis arrow. The horizontal axis represents time and time increases from the left side of the figure to the right side of the figure.

The second plot from the top of FIG. 4 is a plot of an amount of hydrocarbons that are stored or trapped in a left hydrocarbon trap (e.g., 208 of FIG. 2) of an engine intake system versus time. The vertical axis represents the amount of hydrocarbons that are stored or trapped in a left hydrocarbon trap of an engine intake system and amount of hydrocarbons stored in a left hydrocarbon trap increases in the direction of the vertical axis arrow. Trace 404 represents the amount of hydrocarbons that are stored in the left hydrocarbon trap. The horizontal axis represents time and time increases from the left side of the figure to the right side of the figure.

The third plot from the top of FIG. 4 is a plot of an amount of hydrocarbons that are stored or trapped in a right hydrocarbon trap (e.g., 202 of FIG. 2) of an engine intake system versus time. The vertical axis represents the amount of hydrocarbons that are stored or trapped in a right hydrocarbon trap of an engine intake system and amount of hydrocarbons stored in a right hydrocarbon trap increases in the direction of the vertical axis arrow. Trace 406 represents the amount of hydrocarbons that are stored in the right hydrocarbon trap. The horizontal axis represents time and time increases from the left side of the figure to the right side of the figure.

The fourth plot from the top of FIG. 4 is a plot of left engine throttle (e.g., 212 of FIG. 2) position versus time. The vertical axis represents left engine throttle position and the opening amount of the left throttle increases in the direction of the vertical axis arrow. Trace 408 represents the position of the left engine throttle. The horizontal axis represents time and time increases from the left side of the figure to the right side of the figure.

The fifth plot from the top of FIG. 4 is a plot of right engine throttle (e.g., 64 of FIG. 2) position versus time. The vertical axis represents right engine throttle position and the opening amount of the right throttle increases in the direction of the vertical axis arrow. Trace 410 represents the position of the right engine throttle. The horizontal axis represents time and time increases from the left side of the figure to the right side of the figure.

The sixth plot from the top of FIG. 4 is a plot of engine catalyst operating state versus time. The vertical axis represents engine catalyst state and the engine catalyst state has not reached a catalyst light-off temperature (e.g., a temperature at which catalyst efficiency may be greater than a threshold) when trace 412 is at a lower level near the horizontal axis. The engine catalyst has reached a catalyst light-off temperature when trace 412 is at a higher level near the vertical axis arrow. The horizontal axis represents time and time increases from the left side of the figure to the right side of the figure.

At time t0, the engine is not running (e.g., rotating and combusting fuel) and the amounts of hydrocarbons stored in the left and right hydrocarbon traps is being estimated. The left and right throttles are fully closed. Although in some examples, the left and/or right throttle may be partially open when the engine is stopped. The catalyst is below a catalyst light-off temperature. Such conditions may be indicative that the engine is cold.

At time t1, the engine is cold started and the right throttle is partially opened while the left throttle is fully closed. Fully closing the left throttle prevents air from flowing across the left hydrocarbon trap, thereby preventing hydrocarbons from being released from the left hydrocarbon trap and into the engine before catalyst warm-up is complete. The right throttle is partially opened so that the engine may reach idle speed and support combustion in the engine's cylinders. The left throttle is fully closed since the left hydrocarbon trap is storing a larger amount of hydrocarbons than the amount of hydrocarbons that are stored in the right hydrocarbon trap. By closing the left throttle and opening the right throttle, it may be possible to lower an amount of hydrocarbons that pass through the engine and the catalyst without being combusted as compared to if the left throttle was opened and the right throttle was closed. Since fewer hydrocarbons are stored in the right hydrocarbon trap in this example, fewer hydrocarbons may reach the atmosphere after passing through the engine and the catalyst during engine cold starting.

Between time t1 and time t2, the engine continues to run and the amount of hydrocarbons stored in the left hydrocarbon trap remain constant. The amount of hydrocarbons stored in the right hydrocarbon trap are reduced as the engine draws air over the right hydrocarbon trap causing hydrocarbons to be release from the right hydrocarbon trap. The left throttle remains fully closed and the right throttle remains partially open. The catalyst has not reached light-off temperature.

At time t2, the engine continues running, but the catalyst has now reached its catalyst light-off temperature so that conversion of hydrocarbons may be efficient. The right throttle is partially closed and the left throttle is partially opened in response to the engine's catalyst reaching its light-off temperature. However, in some examples, the left throttle may remain fully closed until the engine operates at a higher engine load. The amount of hydrocarbons that are stored in the left hydrocarbon trap begin to decrease and nearly zero hydrocarbons are stored in the right hydrocarbon trap.

Thus, by selectively opening a first throttle and fully closing a second throttle, emissions of hydrocarbons may be reduced. The throttle that is fully closed may correspond to being downstream of a hydrocarbon trap that is estimated to hold a larger amount of hydrocarbons.

Referring now to FIG. 5, a method for operating an engine is described. The method of FIG. 5 may be incorporated into the system of FIGS. 1 and 2 as executable instructions stored in non-transitory memory. The method of FIG. 5 may cause the controller of FIGS. 1 and 2 to receive inputs from one or more sensors described herein and adjust positions or operating states of one or more actuators described herein in the physical world.

At 502, method 500 judges whether or not the engine is off (e.g., not rotating and not combusting fuel). If so, the answer is yes and method 500 proceeds to 503. Otherwise, the answer is no and method 500 proceeds to 504. In one example, method 500 may judge that the engine is off if fuel is not being injected to the engine and engine speed is less than a threshold speed.

At 503, method 500 estimates an amount of hydrocarbons that are stored in a first hydrocarbon trap (e.g., a left hydrocarbon trap). Method 500 also estimates an amount of hydrocarbons that are stored in a second hydrocarbon trap (e.g., a right hydrocarbon trap). In one example, method 500 estimates the amounts of hydrocarbons that are stored in the hydrocarbon traps via monitoring temperature increases in the hydrocarbon traps while the engine is stopped. The amount of hydrocarbons stored in a hydrocarbon trap may be estimated via indexing or referencing a table or function of empirically determined values of hydrocarbon amounts stored in the hydrocarbon traps. The tables or functions may be referenced via temperature increase values. Values in the tables or functions may be determined via monitoring and recording temperature increases within a hydrocarbon trap and then releasing and measuring the amounts of hydrocarbons that are stored in the hydrocarbon traps. Method 500 proceeds to exit after estimating the hydrocarbon amounts that are stored in the hydrocarbon traps.

At 504, method 500 judges if the engine is presently in the process of being cold started. The cold start may last from a time that the engine is cranked to a time when the catalyst reaches its light-off temperature. In one example, method 500 may judge that the engine is being cold started when catalyst temperature is less than a catalyst light-off temperature or a temperature threshold. If method 500 judges that the engine is being cold started, the answer is yes and method 500 proceeds to 506. Otherwise, the answer is no and method 500 proceeds to 530.

At 530, method 500 adjusts the positions of first and second throttles to their respective base positions. In one example, the base positions may be to partially open the first throttle and partial open the second throttle. In other examples, the first throttle may be partially opened and the second throttle may be fully closed. In still other examples, the first throttle may be fully closed and the second throttle may be partially opened. The base throttle positions may allow the engine to reach a desired idle speed while the engine is combusting a stoichiometric air-fuel ratio. Alternatively, if the propulsive effort pedal is applied, the first and second throttles may be adjusted to positions that may be based on engine speed and requested engine torque. Method 500 proceeds to 532.

At 532, method 500 optionally releases a transmission shifter so that a transmission may be engaged into a forward or a reverse gear if it is not already engaged in a forward or reverse gear. Method 500 proceeds to exit.

At 506, method 500 judges if an amount of hydrocarbons stored in a first hydrocarbon trap are greater than an amount of hydrocarbons that are stored in the second hydrocarbon trap. Method 500 may determine the amounts of hydrocarbons stored in the hydrocarbon traps as described at step 503. Method 500 may retrieve amounts of hydrocarbons stored in the first and second hydrocarbon traps from controller memory. If method 500 judges that an amount of hydrocarbons stored in the first hydrocarbon trap is greater than the amount of hydrocarbons stored in the second hydrocarbon trap, the answer is yes and method 500 proceeds to 508. Otherwise, the answer is no and method 500 proceeds to 520.

At 508, method 500 partially opens the second throttle and fully closes the first throttle. By partially opening the second throttle the engine is able to induct an amount of air that is sufficient to allow the engine to reach idle speed. Opening the second throttle may also allow the hydrocarbon trap with fewer stored hydrocarbons to be purged. Fully closing the first throttle may prevent the hydrocarbon trap with greater stored hydrocarbons (the first hydrocarbon trap) to remain unpurged. The engine is also cranked and started and operated at idle speed. The spark timing may be retarded from base spark timing and the engine air-fuel ratio may be lean of stoichiometry to reduce engine hydrocarbon emissions. Method 500 proceeds to 510.

At 510, method 500 optionally prevents a transmission gear shifter or transmission from engaging a forward or reverse gear. In some examples, method 500 may prevent the transmission from engaging a forward or reverse gear via controlling operation of one or more shift solenoids. Thus, the transmission may remain in a park state. Method 500 proceeds to exit.

At 520, method 500 judges if an amount of hydrocarbons stored in a first hydrocarbon trap is equal to an amount of hydrocarbons that are stored in the second hydrocarbon trap. Method 500 may determine the amounts of hydrocarbons stored in the hydrocarbon traps as described at step 503. Method 500 may retrieve amounts of hydrocarbons stored in the first and second hydrocarbon traps from controller memory. If method 500 judges that an amount of hydrocarbons stored in the first hydrocarbon trap is substantially equal to (e.g., within 5%) of the amount of hydrocarbons stored in the second hydrocarbon trap, the answer is yes and method 500 proceeds to 540. Otherwise, the answer is no and method 500 proceeds to 522.

At 522, method 500 partially opens the first throttle and fully closes the second throttle. By partially opening the first throttle the engine is able to induct an amount of air that is sufficient to allow the engine to reach idle speed. Opening the first throttle may also allow the hydrocarbon trap with fewer stored hydrocarbons (the first hydrocarbon trap) to be purged. Fully closing the second throttle may prevent the hydrocarbon trap with greater stored hydrocarbons (the second hydrocarbon trap) to remain unpurged. The engine is also cranked and started and operated at idle speed. The spark timing may be retarded from base spark timing and the engine air-fuel ratio may be lean of stoichiometry to reduce engine hydrocarbon emissions. Method 500 proceeds to 524.

At 524, method 500 optionally prevents a transmission gear shifter or transmission from engaging a forward or reverse gear. Thus, the transmission may remain in a park state. Method 500 proceeds to exit.

At 540, method 500 judges if an amount of hydrocarbons stored in a first hydrocarbon trap is less than a threshold amount (e.g., less than 0.5 milligrams) and if the amount of hydrocarbons that are stored in the second hydrocarbon trap is less than a threshold amount of hydrocarbons (e.g., less than 0.5 milligrams). Method 500 may determine the amounts of hydrocarbons stored in the hydrocarbon traps as described at step 503. Method 500 may retrieve amounts of hydrocarbons stored in the first and second hydrocarbon traps from controller memory. If method 500 judges that the amount of hydrocarbons stored in a first hydrocarbon trap is less than a threshold amount and that the amount of hydrocarbons that are stored in the second hydrocarbon trap is less than a threshold amount of hydrocarbons (e.g., less than 0.5 milligrams), the answer is yes and method 500 proceeds to 542. Otherwise, the answer is no and method 500 proceeds to 550.

At 542, method 500 adjusts the throttles to their baseline positions. The baseline positions may be as described at 530. Method 500 proceeds to exit.

At 550, method 500 partially opens the first or the second throttle and fully closes the other of the first or second throttle. For example, method 500 may partially open the second throttle and fully close the first throttle. In some examples, method 500 may alternate between which throttle is partially open for each engine cold start so that the throttles may be applied equally so that they may perform more equally over time. Method 500 proceeds to 552.

At 552, method 500 optionally prevents a transmission gear shifter or transmission from engaging a forward or reverse gear. Thus, the transmission may remain in a park state. Method 500 proceeds to exit.

In this way, first and second throttles may be adjusted to reduce purging of hydrocarbon traps that are filled with hydrocarbons to a greater extent. Additionally, method 500 strategically selects which throttle to adjust so that fewer hydrocarbons may be released into the engine during a cold start, thereby reducing engine emissions.

Thus, the method of FIG. 5 provides for a method for operating an engine, comprising: adjusting a first throttle to a first position and a second throttle to a second position via a controller in response to an amount of hydrocarbons stored in a first hydrocarbon trap and an amount of hydrocarbons stored in a second hydrocarbon trap. The method includes where the first throttle is in a first intake passage of an engine and where the second throttle is in a second intake passage of the engine. The method includes where the first position is a partially open position, and where the second position is a fully closed position. The method includes where the amount of hydrocarbons stored in the second hydrocarbon trap is greater than the amount of hydrocarbons stored in the first hydrocarbon trap. The method includes where the first hydrocarbon trap and the first throttle are positioned in a first intake passage of an engine, and where the second hydrocarbon trap and the second throttle are positioned in a second intake passage. The method further comprises adjusting the first throttle and the second throttle to base positions after light-off of a catalyst. The method further comprises limiting movement of a transmission shifter while the first throttle is adjusted to the first position and the second throttle is adjusted to the second position.

The method of FIG. 5 also provides for a method for operating an engine, comprising: selectively adjusting a position of a first throttle of a first intake passage of the engine in response to an amount of hydrocarbons stored in a first hydrocarbon trap during a cold engine start. The method further comprises selectively adjusting a position of a second throttle of a second intake passage of the engine in response to an amount of hydrocarbons stored in a second hydrocarbon trap during the engine cold start. The method includes where the first hydrocarbon trap is positioned in a first intake passage upstream of the first throttle, and where the second hydrocarbon trap is positioned in a second intake passage upstream of the second throttle. The method further comprises adjusting the position of the first throttle to a base position when a catalyst temperature reaches a catalyst light-off temperature. The method further comprises adjusting the position of the first throttle to a base position when the amount of hydrocarbons stored in the first hydrocarbon trap is less than a threshold amount of hydrocarbons.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for operating an engine, comprising:

cold starting the engine with an amount of hydrocarbons stored in a first hydrocarbon trap and an amount of hydrocarbons stored in a second hydrocarbon trap; and during the cold starting, adjusting a first throttle to a first position and a second throttle to a second position via a controller in response to the amount of hydrocarbons stored in the first hydrocarbon trap and the amount of hydrocarbons stored in the second hydrocarbon trap, where the first position is more open than the second position, and wherein the amount of hydrocarbons stored in the second hydrocarbon trap is more than the amount of hydrocarbons stored in the first hydrocarbon trap.

2. The method of claim 1, where the first throttle is in a first intake passage of the engine and where the second throttle is in a second intake passage of the engine.

3. The method of claim 2, where the first position is a partially open position, and where the second position is a fully closed position.

4. The method of claim 1, where the first hydrocarbon trap and the first throttle are positioned in a first intake passage of the engine, and where the second hydrocarbon trap and the second throttle are positioned in a second intake passage.

5. The method of claim 1, further comprising adjusting the first throttle and the second throttle to base positions after light-off of a catalyst.

6. The method of claim 1, further comprising limiting movement of a transmission shifter while the first throttle is adjusted to the first position and the second throttle is adjusted to the second position.

7. A system, comprising:

an internal combustion engine including a first intake passage and a second intake passage, the first intake passage including a first throttle and a first hydrocarbon trap, the second intake passage including a second throttle and a second hydrocarbon trap; and a controller including executable instructions stored in non-transitory memory that cause the controller to partially open the first throttle and fully close the second throttle in response to a first amount of hydrocarbons stored in the second hydrocarbon trap greater than a first amount of hydrocarbons stored in the first hydrocarbon trap.

8. The system of claim 7, further comprising additional instructions that cause the controller to partially open the second throttle and fully close the first throttle in response to a second amount of hydrocarbons stored in the first hydrocarbon trap and a second amount of hydrocarbons stored in the second hydrocarbon trap.

9. The system of claim 7, further comprising additional instructions to adjust the first throttle to a first base position and adjust the second throttle to second base position in response to a temperature of a catalyst exceeding a threshold temperature.

10. The system of claim 9, where the threshold temperature is a light-off temperature of the catalyst.

11. The system of claim 7, where the first hydrocarbon trap is positioned upstream of the first throttle, and where the second hydrocarbon trap is positioned upstream of the second throttle.

12. The system of claim 7, further comprising a transmission shifter and additional instructions to limit movement of the transmission shifter while the first throttle is partially open and the second throttle is fully closed.

13. The system of claim 7, further comprising additional instructions to estimate the first amount of hydrocarbons stored in the first hydrocarbon trap and the first amount of hydrocarbons stored in the second hydrocarbon trap while the internal combustion engine is stopped.

14. The system of claim 13, further comprising additional instructions to adjust the first throttle to a first base position and adjust the second throttle to second base position in response to a temperature of a catalyst exceeding a threshold light-off temperature.

15. The system of claim 7, wherein the instructions further include partially opening the first throttle so that the internal combustion engine reaches idle speed during a cold start and supports combustion in cylinders of the internal combustion engine.

* * * * *